United States Patent [19]

Oberst

[11] Patent Number: 5,050,139

[45] Date of Patent: Sep. 17, 1991

[54] TIDE CLOCK

[76] Inventor: E. Ernest Oberst, 404 Patton Dr., Cheshire, Conn. 06510

[21] Appl. No.: 668,486

[22] Filed: Mar. 13, 1991

[51] Int. Cl.[5] ..... G04B 19/26

[52] U.S. Cl. ..... 368/19

[58] Field of Search ..... 368/14, 19; 235/88 R, 235/88 N

[56] References Cited

U.S. PATENT DOCUMENTS 3,745,313 7/1973 Spilhaus ..... 368/19

4,035,617 7/1977 Banner ..... 368/19

4,623,259 11/1986 Oberst ..... 368/19

4,849,949 7/1989 Voth ..... 368/19

*Primary Examiner*—Vit W. Miska

*Attorney, Agent, or Firm*—Chilton, Alix & Van Kirk

[57] ABSTRACT

A tide clock employs a tide dial and a solar time dial which are rotatably driven at different uniform rates by a timepiece. The time of the next high or low tide is indicated by alignment of selected indicia on the dials. A graphical indication of the current status of the tidal stage is also continuously represented on the clock. The clock may also be employed to readily determine the approximate time of the high tide for up to fourteen succeeding days.

20 Claims, 3 Drawing Sheets

TIDE CLOCK

BACKGROUND OF THE INVENTION

This invention relates generally to tide clocks. More particularly, the present invention relates to tide clocks from which the high and low tides may be derived for a given day, as well as for subsequent days.

In U.S. Pat. No. 4,623,259 of the inventor of the present invention, a tide timer provides a live imitation of the rising and the falling water level during each tide. The tide timer provides an indication of the time until the next high or low tide including whether the tide is incoming or outgoing from observation of a water level on the timer. The time of the high or low tide can be derived by reading the time indicated by a moving hand relative to a coordinated time dial which is manually set to the current time of the reading. The tide timer employs a tidal disk which is mounted to a timepiece drive shaft for driving the tidal disk at a uniform rate of one revolution during a whole number of tide time cycles. The face plate has a longitudinal window with the opposite ends denoting high and low water levels. The tidal disk bears a symmetrical figure which is configured to appear in the window as a rising and falling water level moving at a substantially uniform rate on passage across the window under the rotational drive of the disk during each successive tide time cycle to thereby indicate the present position of the tide. The tide times for up to fourteen succeeding days may be determined by cross reference to the solar time dial and a scale affixed to a stationary face plate. While the tide timer of U.S. Pat. No. 4,623,259 provides accurate and reliable information on the times of various tidal events, manual manipulation of the time dial is generally required to obtain an accurate time reading.

Additional patents disclosing tide clock devices to which the invention relates are identified by Patentee and U.S. Pat. No. below.

| Patentee | U.S. Pat. No. |
|---|---|
| Wood | 3,524,313 |
| Appelberg | 3,703,804 |
| Wlodyka | 3,708,971 |
| Leone | 3,921,383 |
| Banner | 4,035,617 |

SUMMARY OF THE INVENTION

Briefly stated, the invention in a preferred form is a tide clock which provides to the observer the current condition of the tide and the time of the next high and low tide without requiring manual manipulation or adjustment of the clock. The time of occurrence of a tide event is readily ascertained from cross-reference to the indicia on a solar time dial and a tide dial. In addition, a straightforward manipulation of a bezel will allow the observer to determine the times for the various tidal events for one to fourteen subsequent days by readily cross-referencing scales on the solar time dial and on the bezel.

In a preferred embodiment, the tide clock comprises a frame which mounts a timepiece. A tide dial is mounted to the frame for rotation about a first axis. A solar time dial is also mounted to the frame for rotation about the first axis. The timepiece, the tide dial, and the solar time dial are mechanically coupled so that the timepiece rotatably drives the tide dial at a first uniform rate of one revolution during one or two complete tide time cycles and also drives the solar time dial at a second uniform rate of one revolution during a whole twelve hour or twenty-four hour time cycles. A face plate is mounted to the frame. The face plate has a window with opposing ends for denoting high and low water levels. The tide dial bears a geometric field which appears in the window as a raising and falling water level. The represented water level moves at a substantially uniform rate on the annular passage of the tide dial across the window during each successive tide time cycle. An hour scale on the time dial and hands on the tide dial provide indicia for visually deriving the times of the various tidal events. A bezel is also freely rotatable about the first axis and manually positionable to indicate the time of the high tide for up to fourteen succeeding days.

An object of the invention is to provide a new and improved tide clock for indicating the times of various tidal events.

Another object of the invention is to provide a new and improved tide clock from which an observer may readily determine the time of a high tide or a low tide or any other tide stage without manual manipulation of any dials on the clock.

A further object of the invention is to provide a new and improved tide clock of efficient construction for determining the current status of a tidal stage in both a graphical and a clock face form, as well as providing for information concerning the time of tidal stages or events for up to fourteen succeeding days.

Other objects and advantages of the invention will become apparent from the drawings and the specification.

DETAILED DESCRIPTION OF THE PREFERRED EMBODIMENT

Figure 1:
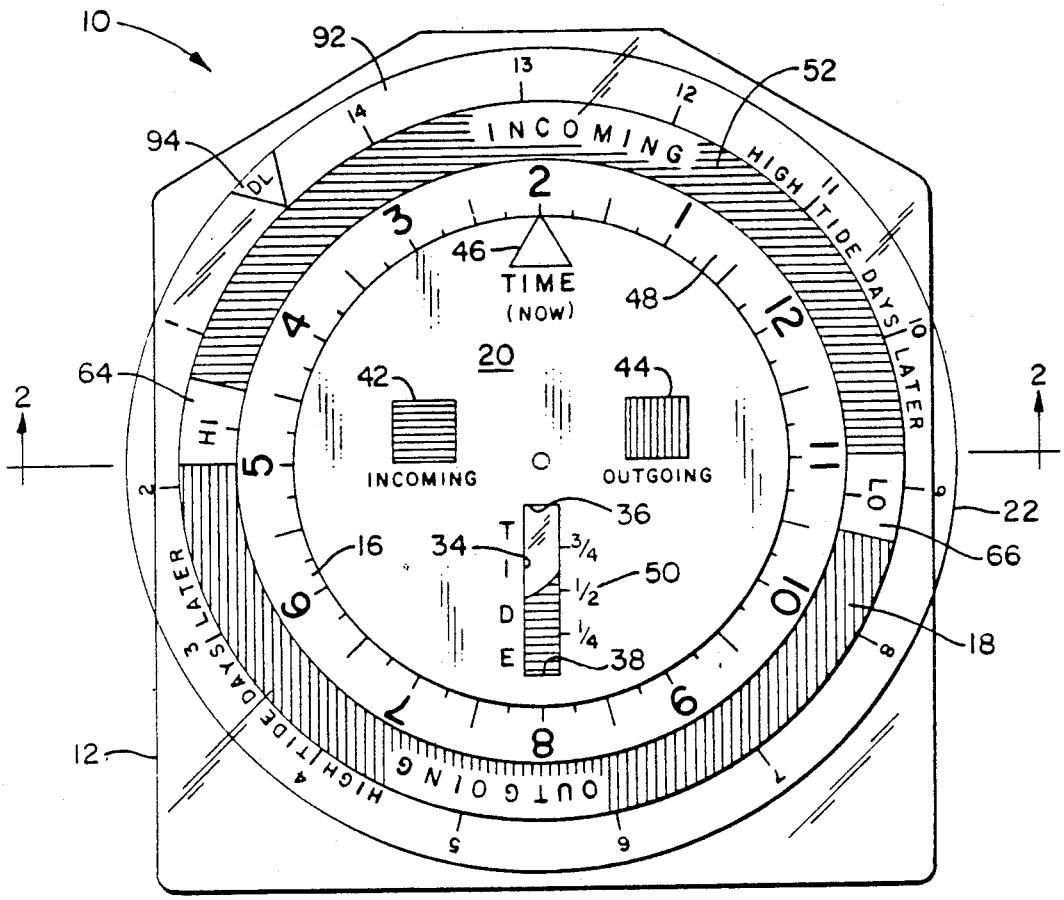
FIG. 1 is a front elevational view of a tide clock in accordance with the present invention.
Figure 2:
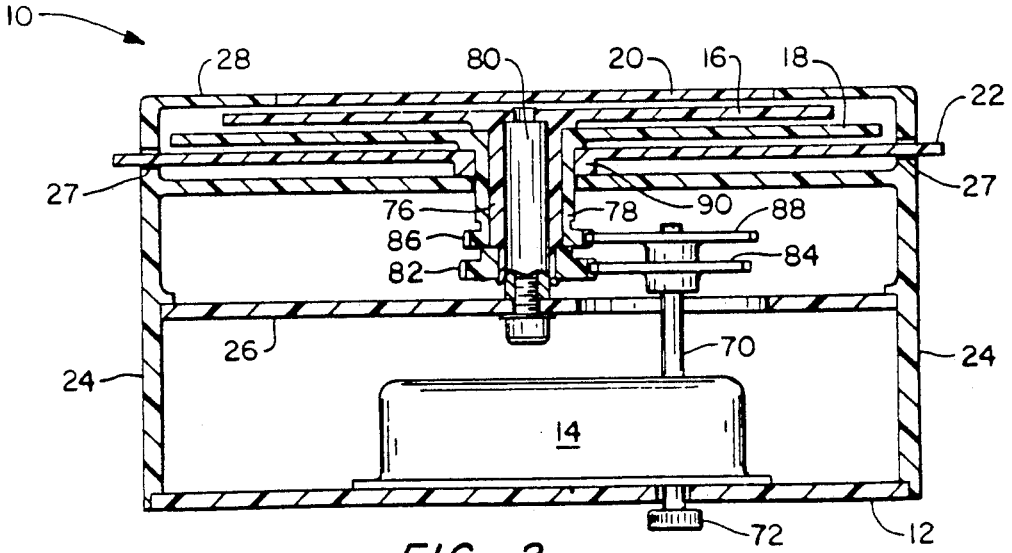
FIG. 2 is a sectional view of the tide clock of FIG. 1, taken along the line 2—2 thereof.
Figure 3:
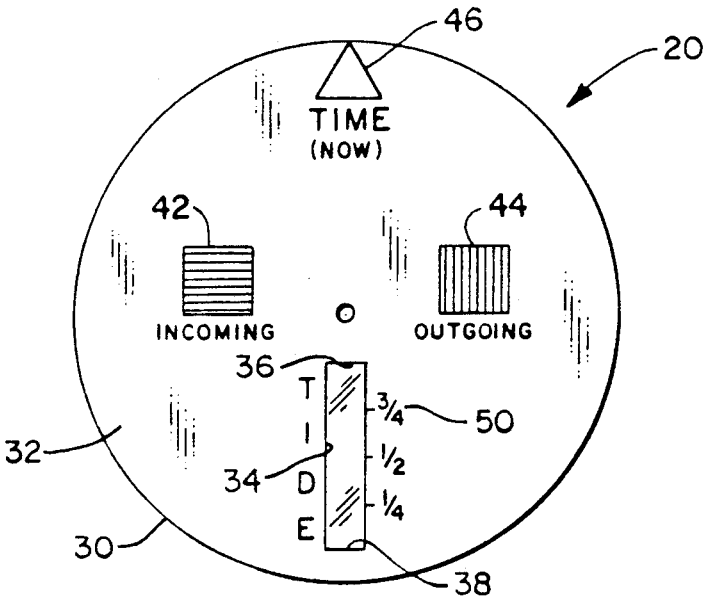
FIG. 3 is a front elevational view of a face plate employed in the tide clock of FIG. 1.

With reference to the drawings wherein like numerals represent like parts throughout the several figures, a tide clock in accordance with the present invention is designated generally by the numeral 10. The tide clock 10 has a case 12 which houses a timepiece 14. The timepiece 14 drives a solar time dial 16 (FIG. 4) and a lunar tide dial 18 (FIG. 5) relative to a stationary frontal face plate 20. A bezel 22 (FIG. 6) is freely rotatable relative to the stationary face plate 20 as well as the solar time dial 16 and the tide dial 18. With reference to FIG. 1 and 2, the face plate 20, solar time dial 16, tide dial 18 and the bezel 22 are disposed in front to back relationship forwardly of the timepiece 14 and are concentrically disposed and dimensioned in progressive diametrical relationship so that their peripheral indicia scales are alignable to provide tidal time and status information as will be detailed below.

The case 12 is preferably manufactured from molded plastic or other suitable material and includes a pair of spaced sidewalls 24 and a transverse partition 26. The sidewalls 24 include diametrically opposed slots 27 through which peripheral portions of the bezel 22 extend. Manual rotation of the bezel is accomplished by grasping a bezel portion extending exteriorly from the slots and appropriately angularly displacing the bezel.

The front panel 28 of the case may be formed of a transparent plastic or other transparent material. The stationary front face plate 20 is essentially centrally defined by an opaque covering, for example, a suitably affixed paper disk 30 which defines an opaque central field 32. A rectangular slot in the disk defines a vertically oriented longitudinal window 34 which extends generally radially below the central axis of the face plate. The window 34 in cooperation with a portion of the tide dial 18 provides a graphical representation of the present status of the tide, as will be described below. A geometric figure affixed to the tide dial moves between opposite ends 36 and 38 of the window to illustrate the tidal high and low water levels respectively. The high water level end 36 of the window is located closer to the center axis of the face plate than the low water level end 38. The opaque field also is affixed with vertical graduations 50 and associated indicia alongside the portions adjacent the window to express the illustrated water levels in fractions of the overall maximum high tide water level. The face plate is also provided with legends 42 and 44 which consists of rectangular color coded rectangles identifying either the incoming or outgoing tide, as graphically displayed in the window. In addition, an arrow 46 at the upper portion of the face plate aligns with a rotating clock face on the solar time dial to indicate the present time.

Figure 4:
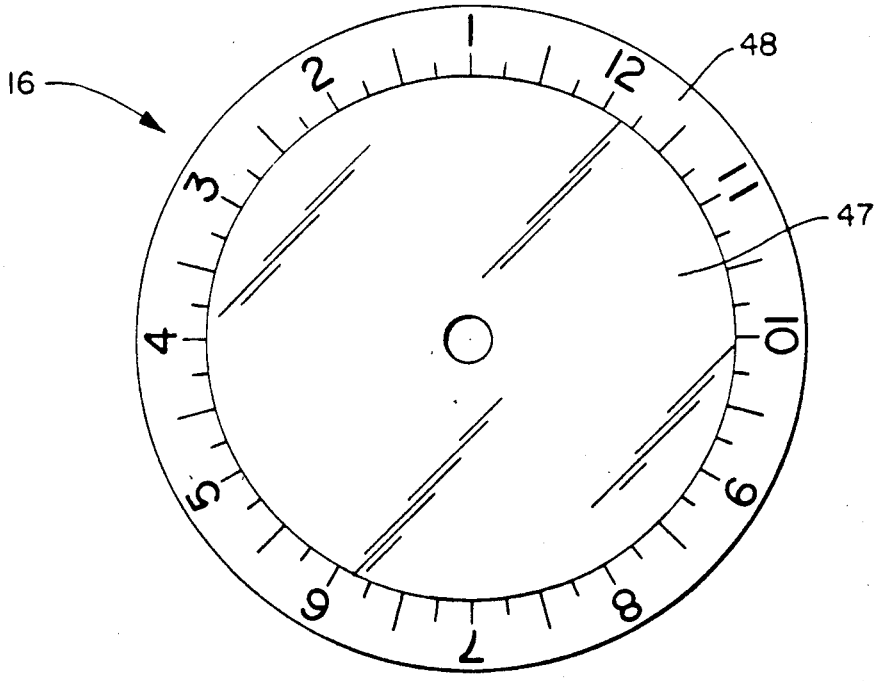
FIG. 4 is a front elevational view of a solar time dial employed in the tide clock of FIG. 1.

The solar time dial 16 may be manufactured from a transparent plastic or other suitable transparent material. With reference to FIG. 4, the solar dial 16 comprises a disk with a central opening. The disk has a transparent central field 47 and a peripheral obverse clock face 48 with twelve hour graduations to provide an exemplary twelve hour-type timer. The peripheral graduations progressively increase opposite to the rotational direction of the solar time dial.

Figure 5:
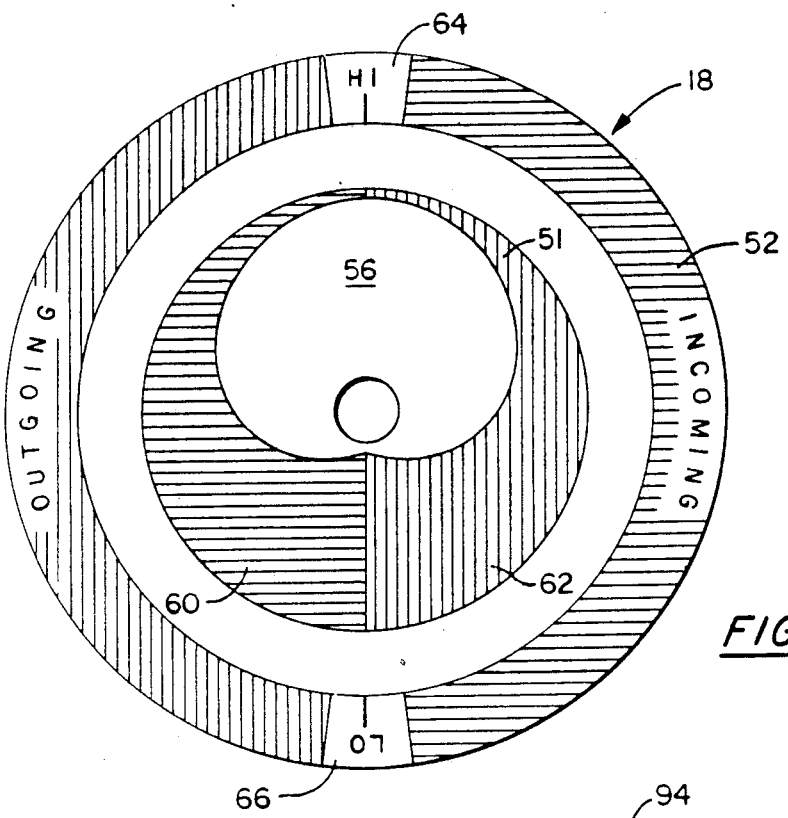
FIG. 5 is a front elevational view of a tide dial employed in the tide clock of FIG. 1.

With reference to FIG. 5, the tide dial 18, which also is disk-shaped with a central opening, may be manufactured from any suitable transparent or opaque plastic or other material. The dial face is divided into a central field 51 about the central axis of the dial and a surrounding peripheral field 52 which extends radially beyond the edge of the solar time dial 16. The central field 51 is substantially congruent to the central field 32 of the face plate. The central field includes a cardioid-shaped FIG. 56 which functions to provide a graphical representation of the water level through the window 34 at the front plate. The central field 51 is further sub-divided into complements 60,62 of the symmetrical lobes of the cardioid 56. The color of the cardioid 56 contrasts with two different colors of the central field complements 60,62 of the symmetrical lobes of the cardioid figure. The different colors of the complements 60,62 correspond to the colors on the legends 42,44 at the face plate. The peripheral field 52 on the tide dial bears diametrically opposed hands 64,66, which are aligned with the axis of the cardioid FIG. 56. The hands 64,66 associated with the respective high and low tides are identified by the respective explanatory legends "HI" and "LO". As illustrated in FIG. 5, the peripheral field is also sub-divided into two arcuate sections which are respectively affixed with explanatory legends "INCOMING" and "OUTGOING" at generally equiangular spacing from the tide hands 64,66. The peripheral field sections designated "INCOMING" and "OUTGOING" have colors corresponding to the legends 42,44 at the face plate.

The timepiece 18 is operated by a replaceable battery (not illustrated) or other drive for driving an operating shaft 70 at a uniform rate as will be described below. The timepiece has an on-off switch (not illustrated) for the battery and an adjustment knob 72 which is manually turnable in either a clockwise or counter-clockwise direction to adjust the position of the operating shaft 70.

The solar time dial 16 and the tide dial 18 have concentric axial sleeves 76 and 78, respectively, which are angularly fixed relative the respective dials and are relatively rotatable. Sleeve 76 rotatably mounts on a central shaft 80 which axially extends between partition 26 and panel 28. The solar time dial 16 and the tide dial 18 are coupled to the operating shaft 70 so that the tide dial rotates one revolution per tide time cycle of 12 hrs. 25½ minutes and the solar time dial rotates at a rate of one revolution per twelve hour period. In order to accomplish the foregoing differential rotation rates, a gear 82 rotatably fixed or integrally connecting to sleeve 76 meshes with a gear 84 which is rotatably fixed with shaft 70, and a gear 86 rotatably fixed or integrally extending from sleeve 78 meshes with a gear 88 rotatably fixed with shaft 70. An appropriate gearing relationship is thus provided to implement the required differential rotation rates between the tide dial 18 and the solar time dial 16. For example, in one possible embodiment, the timepiece drive shaft 70 rotates at a uniform rate of one revolution per twelve hour cycle. Gears 86 and 88 are configured to implement a corresponding rotation for the tide dial 18 which requires 12 hrs. and 25½ minutes. Alternately, the rotation of the shaft 70 may be configured to provide for a lunar revolution in a period of 12 hrs. 25°. The gears 82 and 84 would accordingly be configured to implement a corresponding revolution per twelve hour time period for the solar time dial. It should also be appreciated that multiple solar time and lunar tide cycles may also be employed for a given whole number of revolutions (with corresponding modifications to the solar time dial 16, tide dial 18 and bezel 22), and various other corresponding gear relationships and configurations are also possible.

The solar time dial 16 and the tide dial 18 rotate in the same direction which for the illustrated embodiment is the clockwise direction. The dials may also rotate in the counter-clockwise direction with the dial faces being accordingly modified. For example, the hour scale would progressively increase in the clockwise direction.

Figure 6:
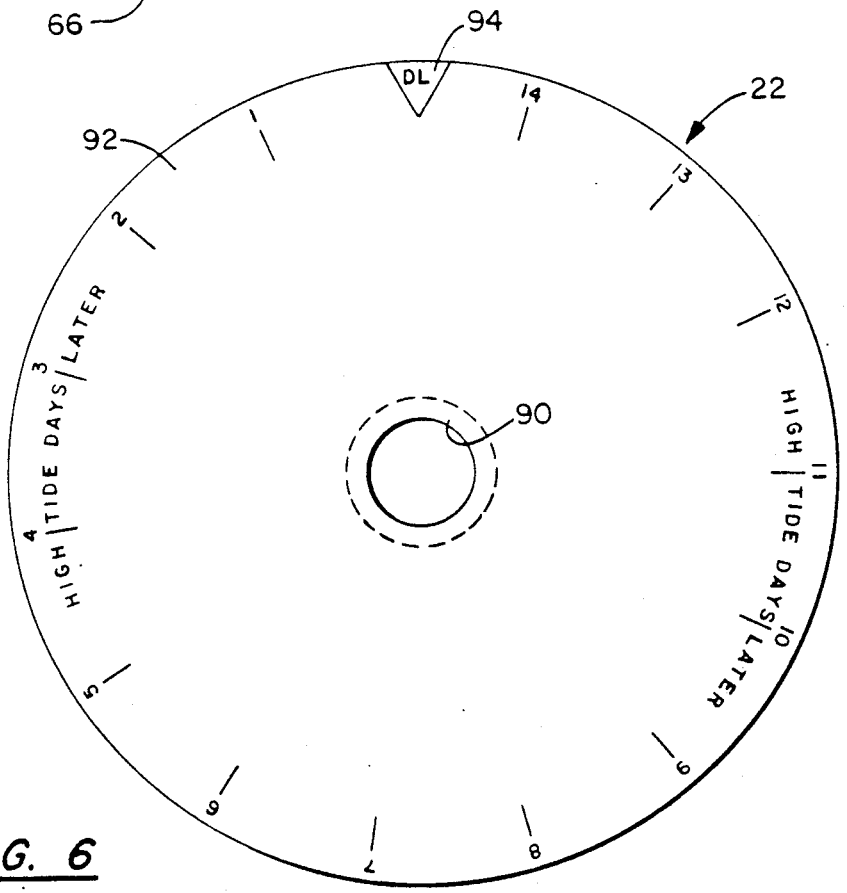
FIG. 6 is a front elevational view of a bezel employed in the tide clock of FIG. 1.

With reference to FIG. 6, the bezel 22 has a hub 90 which is dimensioned so that the bezel is mountable to sleeve 78 to provide for free rotation relative thereto. The bezel 22 includes a peripheral field 92 having graduations and indicia for secondary time marks corresponding to subsequent days, e.g., one to fourteen, which progressively increase opposite to the drive direction of the solar time and tide dials around the peripheral field. The zero mark is indicated by an arrow 94 and the legend "DL" (meaning "days later") or other appropriate legend. The bezel may be manually moved for alignment of the "DL" arrow 94 on the bezel with the high tide hand 64 of the tide dial 18 to obtain the approximate time of the high tides on subsequent days. Similarly, if the "DL" arrow is positioned at the low tide hand 66 one may obtain the approximate time for the low tide on subsequent days. The subsequent day tides are derived by the alignment of the numerals on field 92 with the time scale on the clock face 48. Alternately, the case may be rounded and have a transparent cover plate disposed forwardly of face plate 20. The bezel may be retained between a front annular edge of the case and angularly spaced projections extending from the side of the cover plate. For such an embodiment, the bezel may be positioned axially forwardly from the time dial and the tide dial.

The tide clock requires initial adjustment at any desired locality by referring to high or low tide times which are conventionally given for each day in local newspapers or other publications. The timepiece 14 may be stopped, and the solar time dial 16 and the tide dial 18 appropriately indexed relative to the face plate current time arrow 46. The timepiece 14 is then started at the time given for the next tide time on that same day. The tide clock 10 is then set for the given locality as long as the time piece 14 continues to operate.

For indexing the tide clock at a high tide indication, the clock may be readily adjusted from any tide indication to any high tide indication by simply turning the knob on the time piece in the appropriate direction until the cardioid FIG. 56 assumes the high tide position wherein the axis aligns with the longitudinal axis of the window 34 of the face plate and the high tide complement is fully exposed to view within the window i.e., sector 60 completely fills the window. In the tidal water level imitation in the window, the water level is at the high water level end 36. The tide clock naturally may be advantageously adjusted according to the given time of the next low tide and low water level indication of the timer by displacing the tide dial 180° from the given position so that the cardioid FIG. 56 fully subtends the window 34 to indicate a tidal low water level and consequently a low tide.

A second method to correct and adjust the clock at a particular local tide condition, is to turn the dials 16 and 18 in tandem (provided they are correctly relatively indexed) to conform to the user's present time at the current time mark 46. The adjustment knob 72 on the timepiece is then turned in a corresponding direction until the current time mark 46 is opposite the correct time on the solar time dial.

In operation, the cardioid FIG. 46 and the central field 50 function to indicate the rise and fall of the water level during the tide cycle by angular movement in the window on the front face. The tide dial moves at a uniform rate in the window from one end to the other and back to the end during passage across the window through one revolution, in other words, during a tide time cycle of 12 hrs. and 25½ minutes. In accordance with each tide, the stage at any instant is easily observed by the water level in the window, such as, for example, appears at approximately ½ according to the fractional level of graduation along the window in FIG. 1. Consequently, the water level and the tidal stage are evidenced not only by the relationship of the high tide hand 64, but also by the color of the water level which appears in the window of the front face plate.

With reference to FIG. 1, it will be appreciated that the next high and low tides may be readily ascertained by reference to the angular relationship of the high hand 64 and the low hand 66 to the clock face time scale on the solar time dial. For example, for the illustrated locality and date, the next high tide would be at approximately 4:48 p.m., and the next low tide would be at approximately 10:50 p.m. The current tide stage illustrated in the front face of the window as an incoming tide at approximately ½ the high tide water level. In addition to the foregoing, the observer can relatively easily derive, for example, the approximate time of the high tide for the next day or for up to fourteen succeeding days by manually aligning the high tide arrow 94 on the bezel with the high tide hand 64 on the tidal dial and then reading the appropriate times off the solar time dial. For the illustrated FIG. 1 example, the approximate tides for the seven succeeding days are indicated in Table 1 below.

TABLE I

| Day | High Tide Time |
|---|---|
| 0 | 4:48 p.m. |
| 1 | 5:39 p.m. |
| 2 | 6:30 p.m. |
| 3 | 7:21 p.m. |
| 4 | 8:12 p.m. |
| 5 | 9:03 p.m. |
| 6 | 9:54 p.m. |
| 7 | 10:45 p.m. |

It will be appreciated that the foregoing tide clock employs a pair of rotating dials 16,18 which rotate under the drive of a single timepiece 14 drive mechanism but at different uniform rates. The observer may ascertain the present condition of the tides, both in graphical form and an actual precise time form without touching or otherwise manipulating the clock. The time occurrence is derived by appropriately reading the alignment of the hands with the hour indications on the solar time dial. A graphic simulation of the rise and fall of the tide is also observed through the window 34 of the face plate. In addition, the bezel 22 around the face of the clock provides an efficient means to calculate or derive the time of various stages of the time on subsequent days. Stated differently, the condition of the tidal stage could be derived for any of up to fourteen succeeding days for a given time.

While a preferred embodiment of the foregoing invention has been set for for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A tide clock comprising:

a frame;

timepiece means comprising a drive shaft, said timepiece means mounted to said frame for driving said shaft;

tide dial means mounted to said frame for rotation about a first axis, said tide dial means comprising a water level figure and opposed indicator hands for indicating high and low tides;

solar time dial means mounted to said frame for rotation about the first axis, said time dial means comprising peripheral graduations defining a time scale;

face plate means disposed axially forwardly of said tide dial means and said solar time dial means and defining a window with opposing portions denoting high and low water levels;

gear means rotatably coupling said tide dial means and said solar time dial means to said drive shaft for driving said tide dial means in a first rotation direction at a first uniform rate of one revolution during a whole number of tide time cycles and driving said time dial means in said first rotation direction at a second uniform rate of one revolution during a whole number of twelve hour time cycles, so that said figure moves relative to said window to indicate rising and falling water level during successive tide cycles and the time of the next high and low tides is indicated by alignment of the hands with the time scale of the solar time dial means.

2. The tide clock of claim 1 further comprising a bezel freely rotatable relative to said first axis and having a peripheral scale with a reference mark and having a plurality of graduations which progressively increase opposite to the first rotation direction, and which are angularly spaced from said reference mark by a distance which corresponds to the difference in clock time between identical tides on succeeding days, thereby to permit the reading on the solar time dial means of the approximate clock time of a next high tide of a succeeding day.

3. The tide clock of claim 1 wherein said solar time dial means is axially disposed between said face plate means and said tide dial means.

4. The tide clock of claim 3 wherein said solar time dial means comprises a central transparent portion so that portions of said tide dial means are visible in said window.

5. The tide clock of claim 1 wherein said time scale comprises 12 equiangularly spaced hour graduations and corresponding hour designations which progressively increase in a direction opposite to the first rotation direction.

6. The tide clock of claim 2 wherein said time dial means and tide dial means are axially positioned between said face plate means and said bezel.

7. The tide clock of claim 2 wherein said bezel scale comprises 14 equiangularly spaced graduations and corresponding succeeding day designations which progressively increase opposite to the first rotation direction.

8. A tide clock comprising:

means comprising a forwardly projecting drive shaft, said timepiece means being operable for driving said shaft;

tide dial means mounted for rotation about a first axis, said tide dial means comprising a tide dial face having diametrically opposed indicator hands for indicating high and low tides;

solar time dial means mounted for rotation about the first axis and disposed forwardly of said tide dial means, said time dial means comprising a time dial face having peripheral graduations defining a time scale;

face plate means disposed forwardly of said time dial means and defining a stationary reference point for said time dial means;

gear means rotatably coupling said tide dial means and said solar time dial means to said drive shaft for driving said tide dial means at a first uniform rate of one revolution during a whole number of tide time cycles and driving said time dial means at a second uniform rate of one revolution during a whole number of twelve hour time cycles, so that the current time is indicated by the alignment of the reference point with the time scale and the time of the next high and low tides is indicated by alignment of the tide dial hands with the time scale of the solar time dial means.

9. The tide clock of claim 8 further comprising a bezel freely rotatable relative to said first axis and having a peripheral scale with a primary hand and having a plurality of graduations which progressively increase opposite the direction of rotation of the solar time dial means and which are angularly spaced from said primary hand by a distance which corresponds to the difference in clock time between identical tides on succeeding days, thereby to permit the reading on the solar time dial means of the approximate clock time of a next high tide of a succeeding day.

10. The tide clock of claim 8 further comprising a case enclosing said solar time dial means, said tide dial means, said timepiece means and said gear means.

11. The tide clock of claim 8 wherein said time scale comprises 12 equiangularly spaced hour graduations and corresponding hour designations which progress in a direction opposite to the direction of rotation of said time dial means.

12. The tide clock of claim 9 wherein said time dial means and tide dial means are axially positioned between said face plate means and said bezel.

13. The tide clock of claim 9 wherein said bezel scale comprises 14 equiangularly spaced arcuate graduations and corresponding succeeding day designations which progress opposite to the direction of rotation of the time dial means.

14. The tide clock of claim 8 further comprising graphical display means for continuously graphically representing the whether the current tide change is an outgoing or incoming tide.

15. The tide clock of claim 14 wherein said time dial means is axially positioned between said face plate means and said tide dial means, said time dial means has a transparent portion, said time dial means has a field defining a figure said face plate means defines a window, and said graphical display means comprises means for continuously angularly rotating said figure relative to said window so as to provide a visual display in the window.

16. A tide clock comprising:

tide dial means mounted for rotation about a first axis, said tide dial means comprising a dial face having a water level figure and opposed indicator hands for indicating high and low tides;

solar time dial means mounted for rotation about the first axis and forwardly from said tide dial means, said time dial means comprising a dial face having peripheral graduations defining a time scale;

face plate means disposed axially forwardly of said time dial means and defining a reference mark and a window with opposing portions denoting high and low water levels;

driving means for rotatably driving said tide dial means in a first rotational direction at a first uniform rate of one revolution during a whole number of tide time cycles and said time dial means in said first direction at a second uniform rate of one revolution during a whole number of twelve hour time cycles, so that the current time is indicated by the alignment of a selected position of the time scale and said reference mark, and the time of the next high and low tides is indicated by alignment of the hands with the time scale of the solar time dial means.

17. The tide clock of claim 16 further comprising a bezel freely rotatable relative to said first axis and having a peripheral scale with a primary hand and having a plurality of graduations which progressively increase opposite to the first direction and are angularly spaced from said primary hand by a distance which corresponds to the difference in clock time between identical tides on succeeding days, thereby to permit the reading on the solar time dial means of the approximate clock time of a next high or low tide of a succeeding day.

18. The tide clock of claim 17 wherein said reference mark, said time scale, said tide dial hands and said bezel graduations are respectively positioned at progressively increasing distances from said first axis.

19. The tide clock of claim 16 wherein said time scale comprises 12 equiangularly spaced hour graduations and corresponding hour designations which progress in an opposite direction to said first direction.

20. The tide clock of claim 17 wherein said time dial means and tide dial means are axially positioned between said face plate means and said bezel, and said time scale, said hands and said bezel graduations are positioned at progressive increasing distances from said first axis.

* * * * *